US010611040B2

(12) United States Patent
Huang

(10) Patent No.: US 10,611,040 B2
(45) Date of Patent: Apr. 7, 2020

(54) SHEARING TOOL

(71) Applicant: ALLPROFESSIONAL MFG. CO., LTD., Taichung (TW)

(72) Inventor: Chung-Ping Huang, Taichung (TW)

(73) Assignee: Allprofessional Mfg. Co., Ltd., Taichung (TW)

( * ) Notice: Subject to any disclaimer, the term of this patent is extended or adjusted under 35 U.S.C. 154(b) by 0 days.

(21) Appl. No.: 16/038,297

(22) Filed: Jul. 18, 2018

(65) Prior Publication Data

US 2019/0217490 A1 Jul. 18, 2019

(30) Foreign Application Priority Data

Jan. 17, 2018 (TW) ..... 107101748 A

(51) Int. Cl.
*B26B 13/16* (2006.01)
*B26B 13/26* (2006.01)

(52) U.S. Cl.
CPC ..... *B26B 13/16* (2013.01); *B26B 13/26* (2013.01)

(58) Field of Classification Search
CPC ..... B26B 13/16; B26B 13/26
See application file for complete search history.

(56) References Cited

U.S. PATENT DOCUMENTS 3,416,226 A * 12/1968 Pfaffenbach ..... A01G 3/02 30/261
6,640,442 B2 11/2003 Lin
7,946,039 B2 * 5/2011 Erbrick ..... B23D 21/10 30/251
8,079,150 B2 * 12/2011 Huang ..... B26B 13/16 30/254
9,346,178 B2 * 5/2016 Tsai ..... B26B 13/26
2006/0200996 A1 * 9/2006 Pearman ..... B26B 1/04 30/158
2012/0023756 A1 * 2/2012 Schneider ..... B26B 13/16 30/254
2016/0185000 A1 * 6/2016 Huang ..... B26B 13/16 30/262
2018/0257247 A1 * 9/2018 Yang ..... B26B 13/28

FOREIGN PATENT DOCUMENTS

CA 2976855 A1 * 2/2018 ..... B23D 29/026
DE 102016101426 A1 * 7/2017
TW M337234 U 8/2008
TW 201226135 A 7/2012
TW I389780 B 3/2013
TW M496541 U 3/2015
TW M544404 U 7/2017

* cited by examiner

*Primary Examiner* — Jennifer B Swinney
(74) *Attorney, Agent, or Firm* — Alan D. Kamrath; Karin L. Williams; Mayer & Williams PC

(57) ABSTRACT

A shearing tool includes a first and second shearing portion and a retaining mechanism. The first and second shearing portions are pivotally engaged with each other. The first and second shearing portions are movable relative to each other between a first relative position and a second relative position. The retaining mechanism includes a first retaining portion and a second retaining portion selectively engagable with each other to retain the first and second shearing portions in the second relative position. The first retaining portion is formed on a first retaining member which is pivotally engaged with the first shearing portions. The second retaining portion is formed on a second retaining member which is connected to the second shearing portion.

12 Claims, 5 Drawing Sheets

SHEARING TOOL

BACKGROUND OF THE INVENTION

1. Field of the Invention

The present invention relates to a shearing tool and, particularly, to a shearing tool with a retaining mechanism.

2. Description of the Related Art

TW Pat. No. 1389780 shows a shearing tool including cutting blades pivotally coupled to one another and a retaining mechanism for selectively retaining the cutting blades and preventing them from pivoting with respect to one another. The retaining mechanism includes a retaining plate and a fastener and the retaining plate can be hooked to the fastener to retain the cutting blades. The retaining plate is pivotally mounted on one handle. The fastener is fixed on another handle.

The problem is that it is often difficult to hook the retaining plate to the fastener.

The present invention is, therefore, intended to obviate or at least alleviate the problems encountered in the prior art.

SUMMARY OF THE INVENTION

According to the present invention, a shearing tool includes a first shearing portion, a second shearing portion, and a retaining mechanism. The second shearing portion is pivotally engaged with the first shearing portion. The first and second shearing portions are pivotal about a fulcrum and movable relative to each other between a first relative position in which they are positioned away from each other and include a gap therebetween to receive an object to be cut and a second relative position in which they are positioned adjacent to each other. The retaining mechanism includes a first retaining portion and a second retaining portion selectively engagable with each other to retain the first and second shearing portions in the second relative position and to prevent them from moving to the first relative position. The first retaining portion is formed on a first retaining member which is pivotally engaged with the first shearing portions. The first retaining member is pivotal about an axle. The first retaining member includes a connecting hole and the axle is inserted through the connecting hole and fixed to the first shearing portions. The second retaining portion is formed on a second retaining member which is connected to the second shearing portion.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

Other objectives, advantages, and new features of the present invention will become apparent from the following detailed description of the invention when considered in conjunction with the accompanied drawings.

DETAILED DESCRIPTION OF THE INVENTION

Figure 1:
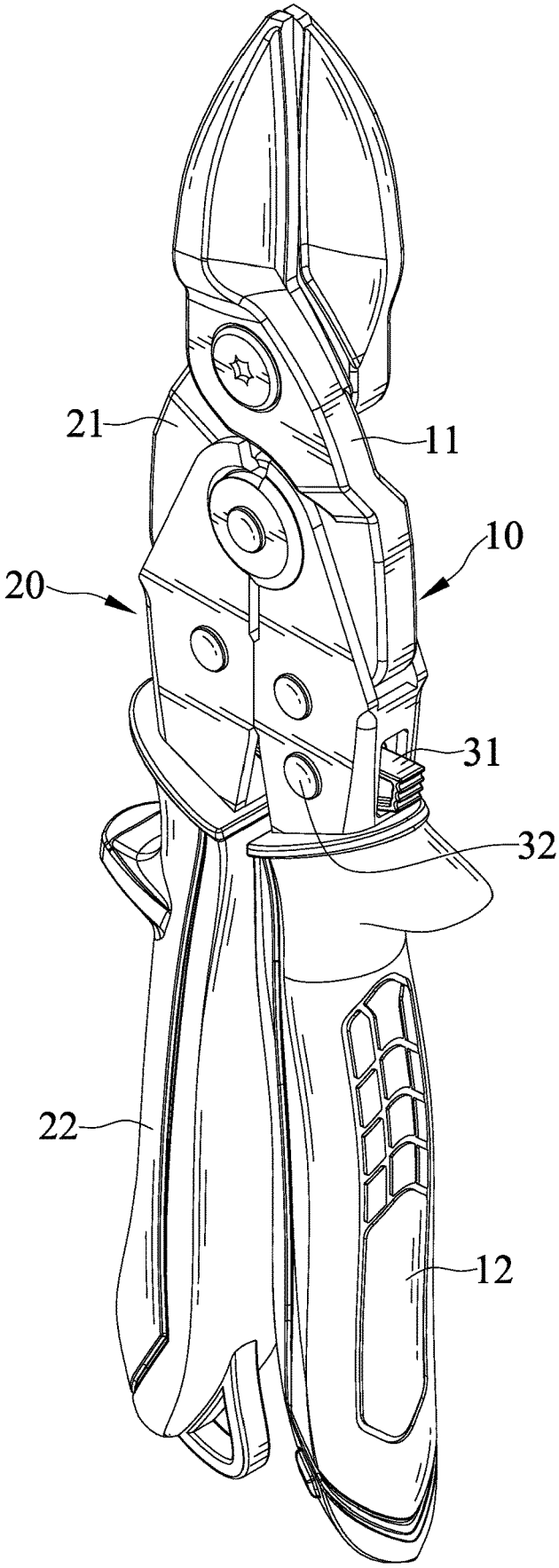
FIG. 1 is a perspective view of a shearing tool in accordance with the present invention.
Figure 2:
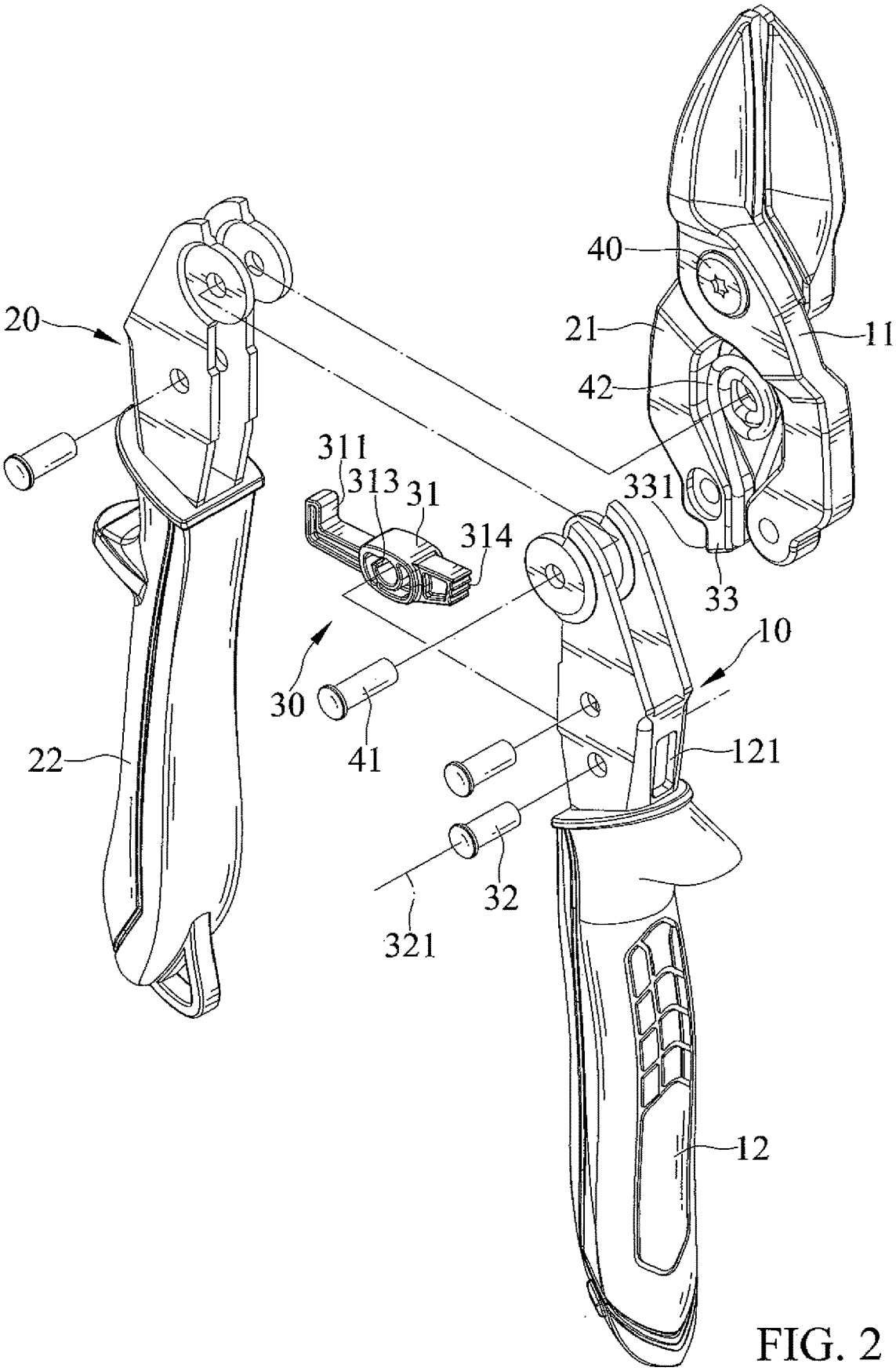
FIG. 2 is an exploded perspective view of the shearing tool of FIG. 1.
Figure 3:
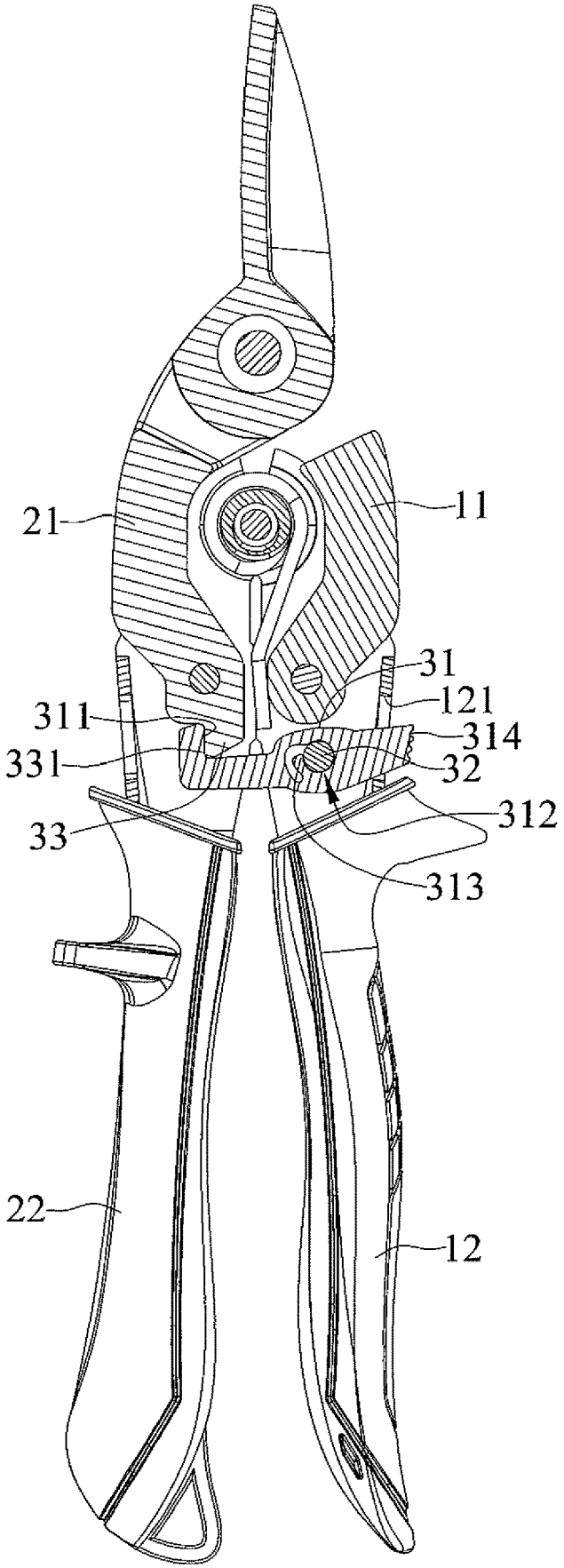
FIG. 3 is a cross-sectional view of the shearing tool of FIG. 1.
Figure 4:
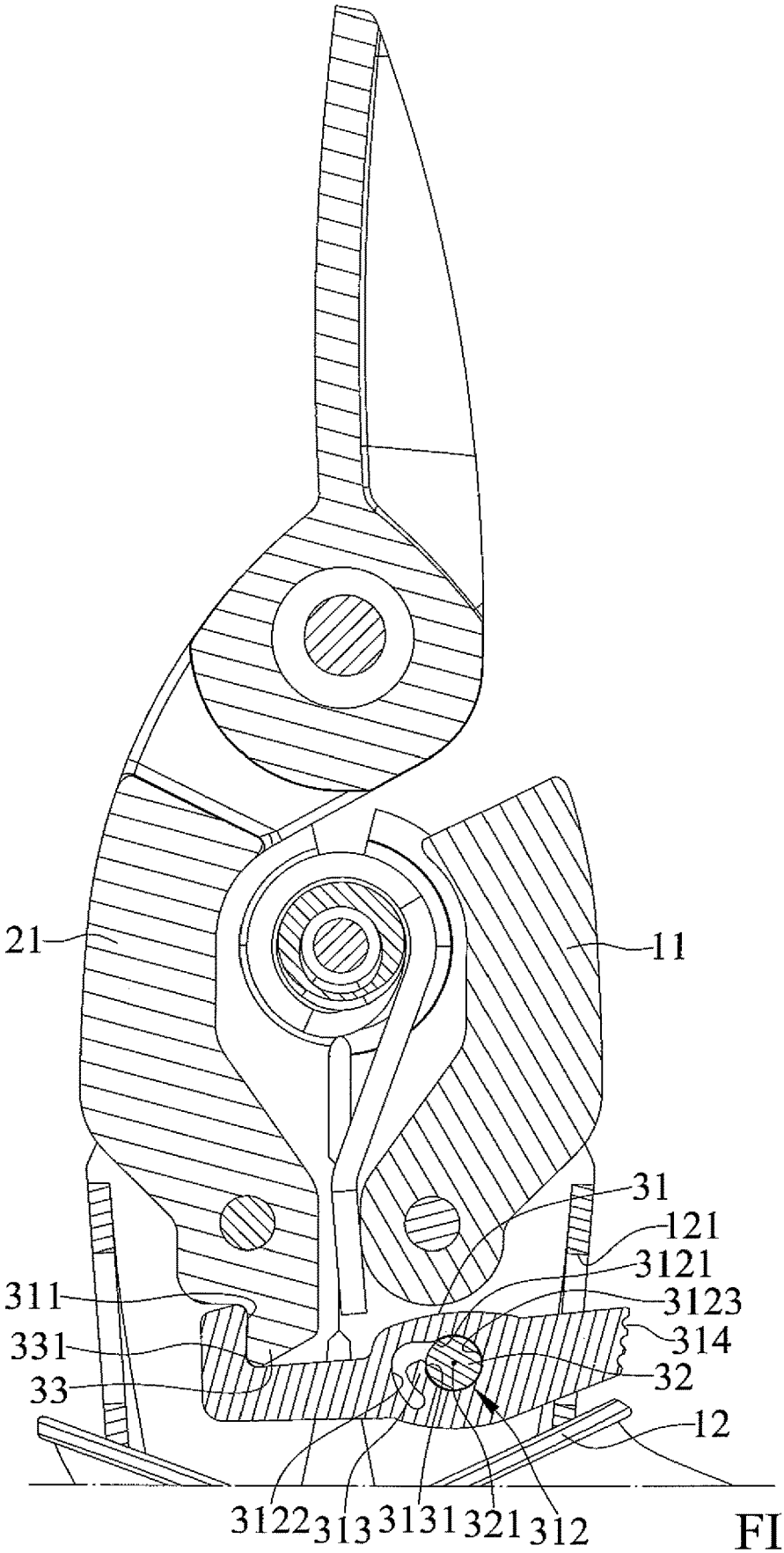
FIG. 4 is a partial enlarged cross-sectional view of FIG. 3.
Figure 5:
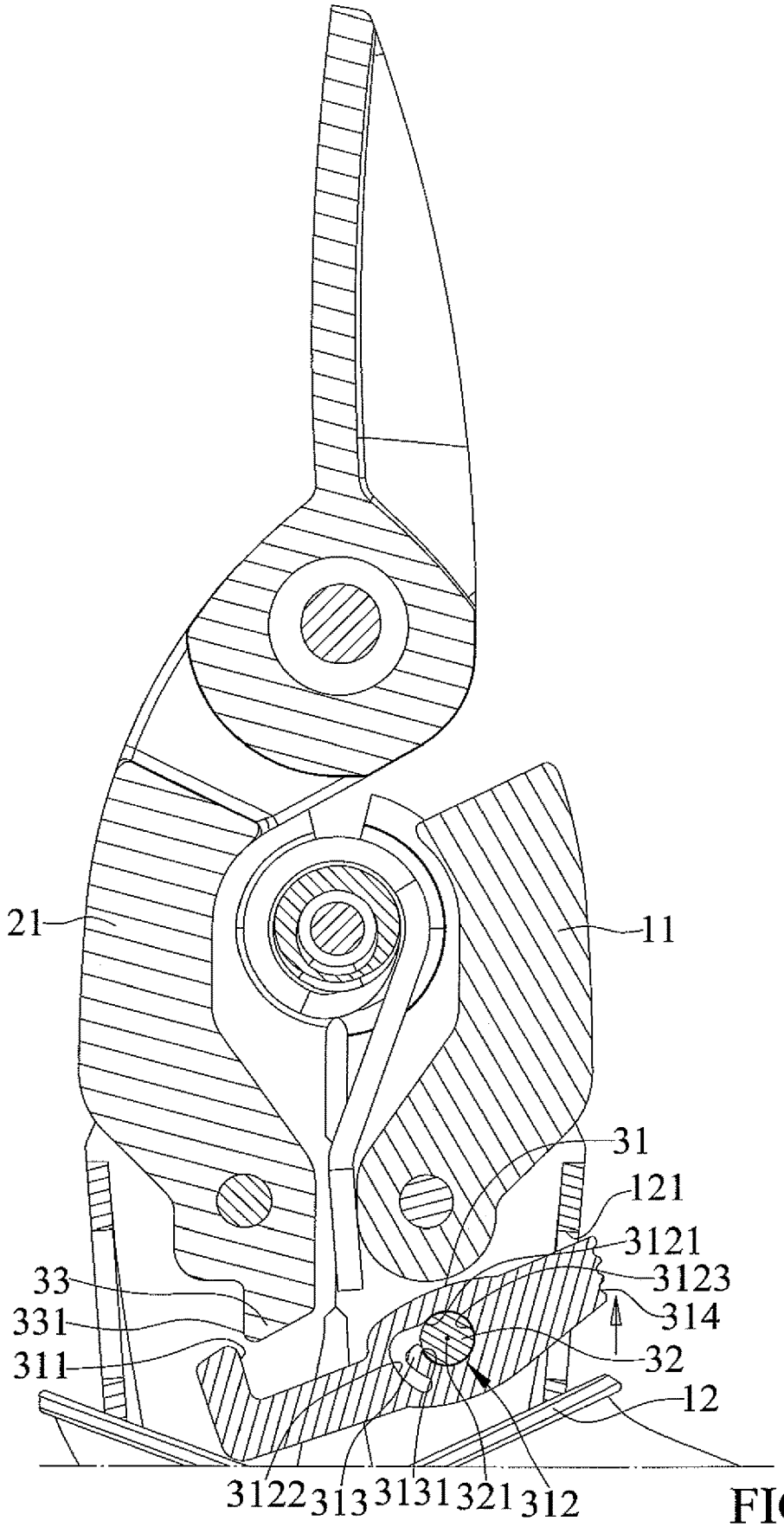
FIG. 5 is a cross-sectional view illustrating the operation of a retaining mechanism of the shearing tool of FIG. 1.

FIGS. 1 through 5 show a shearing tool in accordance with the present invention. The shearing tool includes a first shearing portion 10, a second shearing portion 20, and a retaining mechanism 30.

The first and second shearing portions 10 and 20 are pivotally engaged with each other. The first and second shearing portions 10 and 20 are pivotal about a fulcrum 40 and movable relative to each other between a first relative position in which they are positioned away from each other and include a gap therebetween to receive an object to be cut and a second relative position in which they are positioned adjacent to each other.

The retaining mechanism 30 includes a first retaining portion 311 and a second retaining portion 331 selectively engagable with each other to retain the first and second shearing portions 10 and 20 in the second relative position and to prevent them from moving to the first relative position. The first retaining portion 311 is formed on a first retaining member 31 which is pivotally engaged with the first shearing portion 10. The first retaining member 31 is operably movable. The retaining member 31 includes an actuating portion 314 for facilitating the operation of the retaining member 31. The first retaining portion 311 and the first actuating portion 314 are located at opposite ends of the retaining member 31 and the connecting hole 312 is located therebetween. The first retaining member 31 is pivotal about an axle 32. The axle 32 extends along an axis 321. The first retaining member 31 includes a connecting hole 312 and the axle 32 is inserted through the connecting hole 312 and fixed to the first shearing portions 10. The connecting hole 312 is partitioned by a protuberance 313 into a first section 3121 and a second section 3122. The first section 3121 communicates with the second section 3122. The protuberance 313 extends from a periphery of the connecting hole 312 and is adapted to be biased. The protuberance 313 and the periphery of the connecting hole 312 are integrated and made of the same material. The protuberance 313 has a free end. The axle 32 is retained in the first section 3121 by the protuberance 313. The axle 32 is resiliently retained in the first section 3121 of the connecting hole 312 by the protuberance 313. The first section 3121 and the protuberance 313 respectively have a first and second periphery 3123 and 3131 cooperating with each other and abutting an outer periphery of the axle 32. The first periphery 3123 and the second periphery 3131 are opposite to each other. The first and second periphery 3123 and 3131 extend accurately and conforming to the outer periphery of the axle 32. The axle 32 and the first section 3121 respectively have a first and second cross section taken on a plane which is perpendicular to the axis 321. The first cross section has a size at least equal or greater than a size of the second cross section. The second retaining portion 331 is formed on a second retaining member 33 which is connected to the second shearing portion 20. The second retaining member 33 and the second shearing portion 20 are become integrated and made of the same material.

The first shearing portion 10 and the second shearing portion 20 are adapted to be operably moved in an effort-saving manner and respectively include a shearing blade 11 and 21 and a handle 12 and 22 connected to the shearing blade 11 and 21. The handles 12 and 22 of the first and second shearing portions 10 and 20 are connected to each other. The first and second shearing portions 10 and 20 are pivotal about a pivot 41. The second retaining member 33 is disposed adjacent to the handle 22 of the second shearing portion 20. Further, a torsion spring 41 is disposed on the pivot 41. The torsion spring 41 includes loops and the pivot 41 is inserted through holes of the loops. The torsion spring 41 is disposed between the first and second shearing portions 10 and 20. When operating the shearing tool, a user grasps and applies a force to the handles to cause movement of the first shearing portion 10 with respect to the second shearing portion 20.

Furthermore, the handle 12 of the first shearing portion 10 includes a hole 121 extending therethrough and the actuating portion 314 is exposed and disposed outside of the hole 121. The handle 12 of the first shearing portion 10 includes two side walls disposed in a spaced relationship and the first retaining member 31 is disposed between the two side walls. The actuating portion 314 includes a side with a plurality of ridges. The ridges allow the user to actuate the pivotal movement of the first retaining member 31 without slippery.

In view of the forgoing, the first and second shearing portions 10 and 20, i.e., the shearing blade 11 and 21, can be retained in the second relative position and prevented them from moving to the first relative position. Furthermore, the first and second shearing portions 10 and 20 can be easily retained.

The foregoing is merely illustrative of the principles of this invention, and various modifications can be made by those skilled in the art a without departing from the scope and spirit of the invention.

What is claimed is:

1. A shearing tool comprising:

a first shearing portion and a second shearing portion pivotally engaged with the first shearing portion, wherein the first and second shearing portions are pivotal about a fulcrum and movable relative to each other between a first relative position in which they are positioned away from each other and include a gap therebetween to receive an object to be cut and a second relative position in which they are positioned adjacent to each other; and a retaining mechanism including a first retaining portion and a second retaining portion selectively engagable with each other to retain the first and second shearing portions in the second relative position and to prevent them from moving to the first relative position, wherein the first retaining portion is formed on a first retaining member which is pivotally engaged with the first shearing portions, wherein the first retaining member is pivotal about an axle, wherein the first retaining member includes a connecting hole and the axle is inserted through the connecting hole and fixed to the first shearing portions, and wherein the second retaining portion is formed on a second retaining member which is connected to the second shearing portion, wherein the connecting hole of the first retaining member is partitioned by a protuberance into a first section and a second section, wherein the protuberance extends from a periphery of the connecting hole and is biased by the axle retained in the first section by the protuberance.

2. The shearing tool as claimed in claim 1, wherein the first section and the protuberance respectively have a first and second periphery cooperating with each other and abutting an outer periphery of the axle.

3. The shearing tool as claimed in claim 2, wherein the first and second periphery extends accurately and conforming to the outer periphery of the axle.

4. The shearing tool as claimed in claim 3, wherein the protuberance and the periphery of the connecting hole are integrated and made of the same material.

5. The shearing tool as claimed in claim 1, wherein the first shearing portion and the second shearing portion are adapted to be operably moved in an effort-saving manner and respectively include a shearing blade and a handle connected to the shearing blade, with the handles of the first and second shearing portions connected to each other, and with the first and second shearing portions pivotal about a pivot, and wherein the second retaining member is disposed adjacent to the handle of the second shearing portion.

6. The shearing tool as claimed in claim 5 further comprising a torsion spring disposed on the pivot, wherein the torsion spring includes loops and the pivot is inserted through holes of the loops, and wherein the torsion spring is disposed between the first and second shearing portions.

7. The shearing tool as claimed in claim 5, wherein the first retaining member is operably movable, wherein the retaining member includes an actuating portion for facilitating the operation of the retaining member, wherein the first retaining portion and the first actuating portion are located at opposite ends of the retaining member and the connecting hole is located therebetween.

8. The shearing tool as claimed in claim 7, wherein the handle of the first shearing portion includes a hole extending therethrough and the actuating portion is exposed and disposed outside of the hole.

9. The shearing tool as claimed in claim 8, wherein the handle of the first shearing portion includes two side walls disposed in a spaced relationship and the first retaining member is disposed between the two side walls.

10. The shearing tool as claimed in claim 9, wherein the actuating portion includes a side with a plurality of ridges.

11. The shearing tool as claimed in claim 1, wherein the second retaining member and the second shearing portion are integrated and made of the same material.

12. The shearing tool as claimed in claim 1, wherein the first retaining member is operably movable, wherein the retaining member includes an actuating portion for facilitating the operation of the retaining member, wherein the first retaining portion and the first actuating portion are located at opposite ends of the retaining member and the connecting hole is located therebetween.

* * * * *